US012504020B2

(12) United States Patent
Principalle

(10) Patent No.: US 12,504,020 B2
(45) Date of Patent: Dec. 23, 2025

(54) AXIAL TURBOMACHINE COMPRESSOR WITH CONTROLLED RECIRCULATION BETWEEN THE INNER SHROUD AND THE ROTOR

(71) Applicant: SAFRAN AERO BOOSTERS, Herstal (BE)

(72) Inventor: Rémy Henri Pierre Principalle, Herstal (BE)

(73) Assignee: SAFRAN AERO BOOSTERS, Herstal (BE)

( * ) Notice: Subject to any disclaimer, the term of this patent is extended or adjusted under 35 U.S.C. 154(b) by 0 days.

(21) Appl. No.: 18/840,255

(22) PCT Filed: Feb. 23, 2023

(86) PCT No.: PCT/EP2023/054506

§ 371 (c)(1),
(2) Date: Aug. 21, 2024

(87) PCT Pub. No.: WO2023/161320

PCT Pub. Date: Aug. 31, 2023

(65) Prior Publication Data

US 2025/0180033 A1 Jun. 5, 2025

(30) Foreign Application Priority Data

Feb. 25, 2022 (BE) ..... 2022/5137

(51) Int. Cl.
*F04D 29/16* (2006.01)
*F04D 29/68* (2006.01)

(52) U.S. Cl.
CPC ..... *F04D 29/164* (2013.01); *F04D 29/685* (2013.01)

(58) Field of Classification Search
CPC ..... F04D 29/685; F04D 29/164; F01D 5/084
USPC ..... 415/58.4, 58.5, 58.6, 58.7
See application file for complete search history.

(56) References Cited

U.S. PATENT DOCUMENTS 10,876,549 B2 * 12/2020 Duong ..... F04D 29/681
10,900,366 B2 * 1/2021 Principalle ..... F01D 11/001

FOREIGN PATENT DOCUMENTS

| | | | |
|---|---|---|---|
| EP | 3078804 | A1 | 10/2016 |
| EP | 3599345 | A1 | 1/2020 |
| EP | 3517731 | B1 | 3/2021 |
| FR | 3084395 | A1 | 1/2020 |

OTHER PUBLICATIONS

International Search Report for PCT/EP2023/054506, dated May 1, 2023, pp. 2.

* cited by examiner

*Primary Examiner* — Michael L Sehn
(74) *Attorney, Agent, or Firm* — RANKIN, HILL & CLARK LLP

(57) ABSTRACT

A stage for a turbomachine compressor including a row of stator vanes extending radially inwards from an outer shell to an inner shell housed in a cavity of the rotor, and an air recirculation passage in the cavity, with an air inlet downstream of the inner shell and an air injection outlet between a face guide and an opposite guiding face upstream of the cavity, having profiles inclined radially downstream, relative to a perpendicular to an axial direction. The air injection outlet has a distance greater than or equal to one fifth of a common length, and the air recirculation passage in the cavity is devoid of a device for sealing upstream of the air inlet.

19 Claims, 4 Drawing Sheets

A-A

AXIAL TURBOMACHINE COMPRESSOR WITH CONTROLLED RECIRCULATION BETWEEN THE INNER SHROUD AND THE ROTOR

DOMAIN

The invention relates to the field of turbomachines and more particularly axial turbomachine compressors.

PRIOR ART

An axial turbomachine generally comprises two compressors arranged upstream of a combustion chamber, namely a low-pressure compressor and a high-pressure compressor configured to suck in and compress the air in order to bring it to suitable speeds, pressures and temperatures.

In this regard, each compressor comprises a succession of compression stages each being formed by an annular row of rotor blades called "rotor", and by an annular row of stator blades called "stator".

Clearances between the rotor and the stator are necessary for the proper functioning of the compressor; a solution known from the state of the art consists of positioning the stator cantilevered with a radial clearance between each foot of the stator blades and the rotor.

This assembly has the advantage of being simple and light. However, the pressure difference between the lower surface and the upper surface of each stator blade leads to the creation of a marginal vortex at the level of this clearance which affects the efficiency and operability of the compressor.

To compensate for the appearance of the marginal vortex, it is known among current assemblies to have an interior shroud arranged at the feet of the blades of a stator and inducing a leakage flow of air from the downstream of the stator towards its upstream passing through a cavity under the inner shell. This leakage, or recirculation, flow is generally injected into a primary flow vein in an essentially radial direction, thus joining the main flow of air in order to mix with the latter.

This mixture is not optimal because the leakage flow considerably slows down the main flow of air in the primary flow vein and generates considerable aerodynamic disturbances in the latter, then generating pressure losses and separations of the air from the stator blades which strongly impact the operability of the compressor and therefore the efficiency of the turbomachine.

A solution to this problem consists of positioning a sealing system in the form of several lips at the level of the cavity below the inner shell. This sealing system is configured to reduce the flow rate of the leak flow injected into the primary flow vein.

However, such a sealing system complicates and makes the axial turbomachine heavier and does not succeed in effectively eliminating the aerodynamic disturbances generated by the reinjection of the leak flow. In addition, the wipers can cause a considerable risk of wear to the inner shell due to their friction with the latter, particularly during changes in attitude of the aircraft due to inertia forces.

The published patent document FR 3 084 395 A1 discloses a solution which consists of adding guidance for the reintroduction of the leak flow, comprising a rotor platform configured to axially cover the upstream part of the inner shell provided with cooling fins. rectification of the flow rate of the leakage flow.

However, the improvement proposed by document FR 3 084 395 A1 implies that the clearance between the straightening fins and the upstream rotor platform is much less than the mechanical clearance necessary for the proper functioning of the turbomachine, making the solution difficult to achieve.

SUMMARY OF THE INVENTION

Technical Problem

The invention aims to resolve the drawbacks of the design/manufacture of turbomachine compressors of the state of the art. In particular, the invention aims to propose a solution which makes it possible to limit aerodynamic disturbances at the level of the compression stages of the compressors while respecting the operating clearances and this without complexity and/or addition of additional weight to the compressor of the turbomachine.

Technical Solution

The invention relates to a compression stage for a compressor of a turbomachine, comprising: an annular row of rotor blades extending radially outward from a rotor; and an annular row of stator blades extending radially inward from an outer shroud to an inner shroud housed in a cavity of the rotor, said annular row of stator blades being arranged directly downstream of the annular row of rotor blades; and an air recirculation passage in the cavity, with an air inlet at a downstream part of the inner shroud and an air injection outlet between a guide face upstream of said inner shroud and an opposite guiding face upstream of the cavity, said guide face and opposite guiding face having axial profiles inclined downstream and radially outward, relative to a direction perpendicular to an axial direction; wherein the air injection outlet has a distance (C) corresponding to a gap between the guide face and opposite guiding face, and a length corresponding to a common length (E) of said guide face and opposite guiding face, said distance (C) being greater than or equal to one-fifth of the common length (E), and the air recirculation passage in the cavity is devoid of a sealing device upstream of the air inlet, where upstream refers to a main air flow direction in the compression stage.

Upstream and downstream refer to the direction of flow of an axial air flow in a main stream of the turbomachine. To this end, the air recirculation passage in the cavity is devoid of a sealing device downstream of the air injection outlet and upstream of the air inlet. In fact, the air recirculation passage does not include a sealing device between the air inlet and the air injection outlet. The common length (E) is the length of the overlap or radial overlap of the counter-guiding face by the guide face, the common length (E) extending in the direction of the axial profiles.

By "sealing device" is meant in particular or exclusively one or more wipers in the cavity, facing the radially inner face of the inner shell.

By "upstream of the air inlet", for the absence of a sealing device, reference is made, by convention, to a main flow in the compression stage and not to air recirculation in the cavity.

According to an advantageous embodiment of the invention, the guide face and opposite guiding face are generally parallel and in that the distance (C) between the guide face and opposite guiding face is constant within a tolerance of ±10% along the common length (E) of said guide face and opposite guiding face.

According to an advantageous embodiment of the invention, the guide face and/or the opposite guiding face is/are circular and smooth over a total annular extent of said guide face and/or said opposite guiding face, respectively. By smooth, we mean an absence of aerodynamic structure, such as straightening fins.

According to an advantageous embodiment of the invention, the air injection outlet has a main direction forming an angle with the axial direction that is greater than or equal to 5° and/or less than or equal to 65°, more specifically, said angle being between 25° and 65°.

According to an advantageous embodiment of the invention, the axial profile of the guide face is generally rectilinear within a tolerance of ±10% and extends downstream at least up to a leading edge of the stator blades.

According to an advantageous embodiment of the invention, the axial profile of the guide face, generally rectilinear, extends downstream beyond the leading edge of the stator blades, over an axial distance (X) less than or equal to 50% of an axial chord length (D) of the stator blades.

According to an advantageous embodiment of the invention, the air inlet of the air recirculation passage in the cavity is exclusively located directly downstream of a downstream edge of the inner shroud.

According to an advantageous embodiment of the invention, the air inlet of the air recirculation passage in the cavity comprises at least one orifice radially traversing the inner shroud between two adjacent stator blades.

According to an advantageous embodiment of the invention, the at least one orifice is at a distance from an extrados face of one of the two adjacent stator blades that is less than 50%, preferably 30%, of an average distance between said two adjacent stator blades and located adjacent to a downstream half of said two adjacent stator blades.

According to an advantageous embodiment of the invention, the air inlet of the air recirculation passage in the cavity comprises several orifices of the at least one orifice, distributed with increasing density towards the downstream.

Preferably, the growth in the density of the orifices corresponds to an increase in the number of orifices per unit area at an exterior surface of the interior shell, from upstream to downstream. Preferably, the orifices have a cross section having the shape of a triangle whose base is located downstream.

According to an advantageous embodiment of the invention, the at least one orifice forms a slot extending along a chord direction of the stator blades, at a distance from each of the two adjacent stator blades that is between 40 and 60% of an average distance between said two adjacent stator blades.

According to an advantageous embodiment of the invention, the air recirculation passage in the cavity comprises at least one sealing device downstream of the at least one orifice, where downstream refers to the main air flow direction in the compression stage. In this configuration, the at least one sealing device is arranged in line with the air recirculation passage between the orifice and the air inlet, and the air recirculation passage being devoid of a sealing device between said orifice and the air injection outlet.

The invention also relates to a turbomachine compressor comprising several compression stages.

According to an advantageous embodiment of the invention, said compressor comprises an axial flow path radially delimited externally by a stator wall, and radially delimited internally by the rotor, said axial flow path having a radial height (H), the distance (C) being greater than or equal to one-tenth of said radial height (H).

According to an advantageous embodiment of the invention, the axial flow has a nominal flow rate and the air recirculation passage in the cavity has a recirculation flow rate, said recirculation flow rate re-injected into the axial flow path having with the nominal flow rate a ratio corresponding to at least half of the ratio between a section of the air injection outlet and a section of the axial flow path.

The invention also relates to a turbomachine comprising the compressor.

Advantages of the Invention

The invention is particularly advantageous in that it makes it possible to transform the leak flow, previously negative, into a flow of air injected at a predefined angle favorable to the operation of the turbomachine. The combination of the ratio between the distance between the guide face and counter-face and the common length (E) of said guide face and counter-face, which is greater than 0.2, and the angle of inclination of the outlet of air injection, with the absence of a sealing device in the air recirculation passage, in the cavity, upstream of the air inlet, makes it possible to take advantage of air recirculation in giving it a sufficient flow rate with realistic mechanical tolerances, thus making it possible to energize the air located at the base of the stator vanes in order to accelerate and stabilize the air flow locally.

In addition, the orifices passing radially through the inner shell and forming the air inlet of the air recirculation passage in the cavity, make it possible to suck in the air and stabilize the unstable zones of the stator. In this configuration, the pressure losses are limited, and the operability of the compressor is increased, this advantageously makes it possible to improve the behavior of the compressor.

In addition, the invention proposes a removal of sealing device, of the lip(s) type, in particular between the air inlet and the air injection outlet, which makes it possible to simplify the architecture of the compressor. and therefore, considerably reduce its mass while ensuring significantly improved compression performance, this makes it possible to promote engine efficiency which results in energy efficiency and optimized thrust which advantageously makes it possible to reduce carbon dioxide emissions.

DESCRIPTION OF AN EMBODIMENT

In the description which follows, the terms "internal", "interior", "external" and "exterior" refer to positioning relative to the longitudinal axis of rotation of a turbomachine. The axial direction corresponds to the direction along the longitudinal axis of rotation of the turbomachine. The radial direction is perpendicular to the longitudinal axis. The annular direction is essentially a circular direction around the longitudinal axis. Upstream and downstream refer to the direction of flow of an axial air flow in a main stream of the turbomachine.

The figures show the elements schematically and are not represented to scale. In particular, certain dimensions are enlarged to facilitate reading of the figures.

Figure 1:
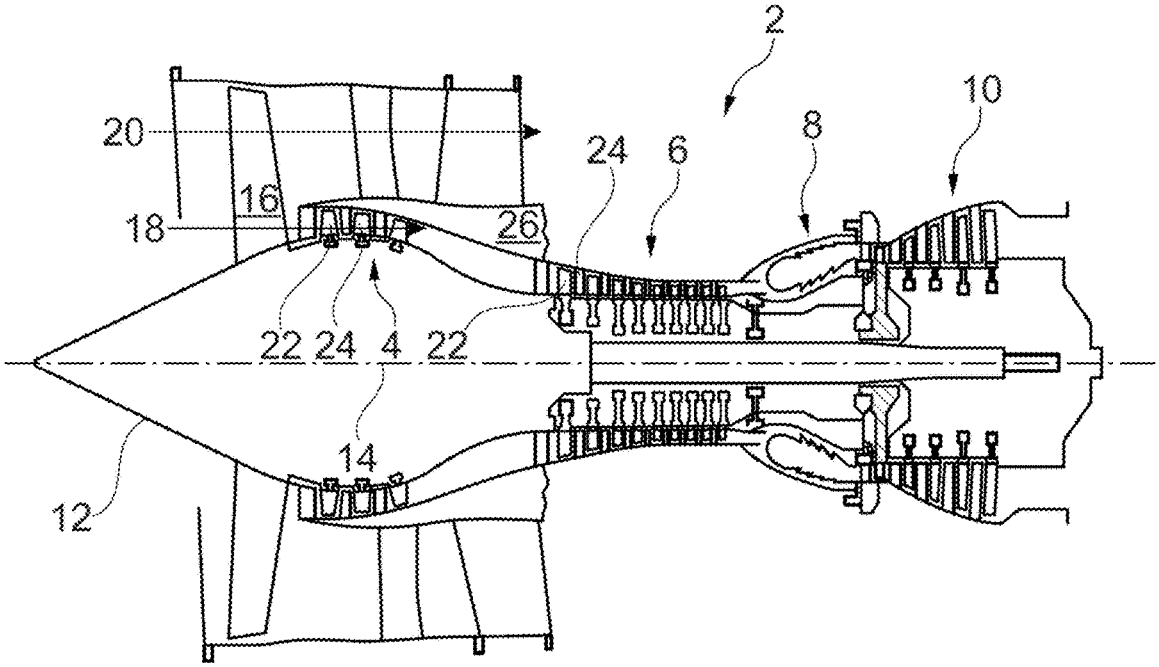
FIG. 1 schematically represents a turbomachine.

FIG. 1 represents in a simplified manner an axial turbomachine 2. In this specific case it is a double-flow turbojet, but can also be a turbojet, turbofan, turboprop or turboshaft.

The turbomachine 2 comprises a first compression level, called low-pressure compressor 4, a second compression level, called high-pressure compressor 6, a combustion chamber 8 and one or more levels of turbines 10.

In operation, the mechanical power of the turbine 10 transmitted via the central shaft to the rotor 12 sets in motion the two compressors 4 and 6. The rotation of the rotor 12 around its axis of rotation 14 thus makes it possible to generate a flow rate of air and gradually compress it until it enters the combustion chamber 8.

A blower or fan 16 is coupled to the rotor 12 and generates an air flow which is divided into an axial air flow 18 called the primary flow 18 passing through the different aforementioned levels of the turbomachine 2, and into a secondary flow 20 passing through a annular conduit (partially shown) along the machine to then join the primary flow at the turbine outlet. The secondary flow can be accelerated so as to generate a thrust reaction necessary for the flight of an aircraft.

Each of the compressors 4 and 6 comprises several compression stages. Indeed, each compression stage comprises an annular row of rotor blades 22 extending essentially radially outwards from the rotor 12. In this regard, the rotor 12 comprises several rows of rotor blades 22. It can for example be a one-piece bladed drum, or include blades with dovetail attachment.

The compression stage also comprises an annular row of stator vanes 24 extending essentially radially inwards from an outer shell belonging to the casing 26 of the turbomachine 2 ensuring the separation of the primary flow 18 and the secondary flow 20.

In the compression stage, the annular row of stator vanes 24 is arranged directly downstream of the annular row of rotor vanes 22.

The compression stage can be produced according to two embodiments which will be fully detailed later in this description.

Figure 2:
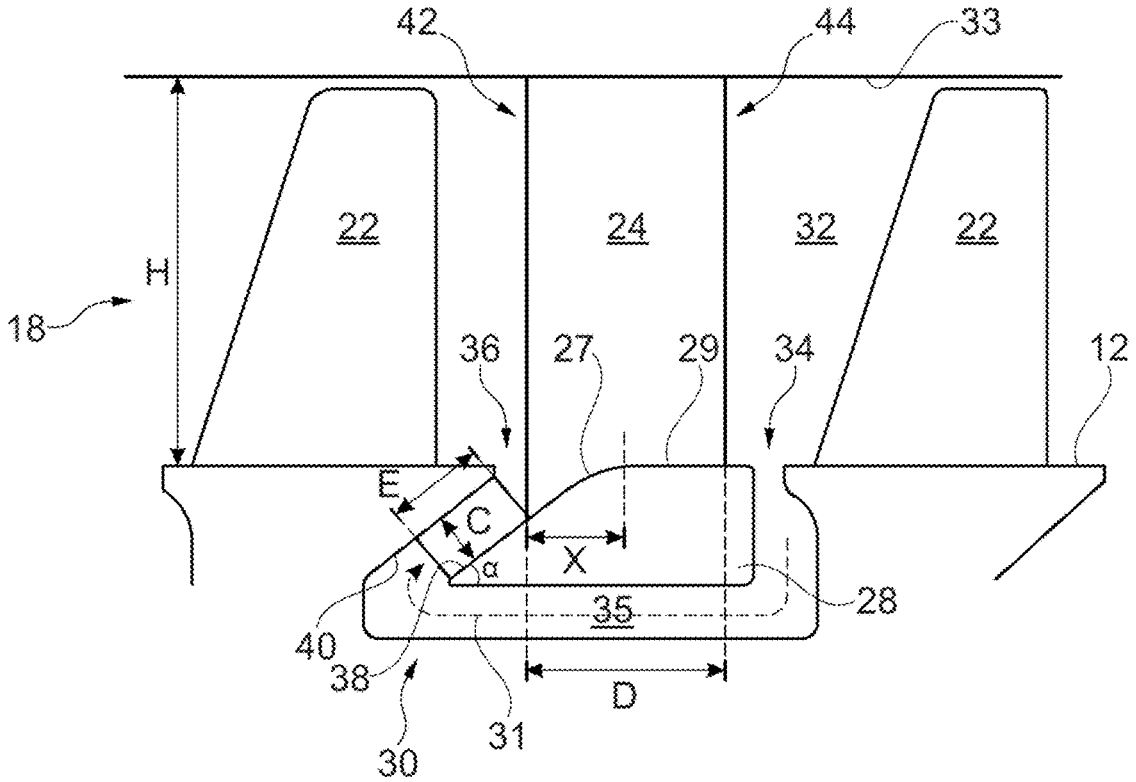
FIG. 2 is a schematic illustration of a compression stage according to a first embodiment of the invention.

FIG. 2 is a schematic illustration of the compression stage according to a first embodiment of the invention.

With reference to FIG. 2, the annular row of stator vanes 24 extends radially inwards to an inner shell 28 housed in a cavity 30 of the rotor. Preferably, the inner shell 28 is entirely formed with the row of stator vanes 24, and more preferably, the inner shell 28 is in one piece with the stator vanes 24.

The primary flow 18 advances in an axial flow vein 32 having a nominal flow rate and a radial height H delimited radially externally by a stator wall 33 belonging to the casing of the turbomachine. The vein 32 is delimited radially internally by the rotor 12 and an upper face 29 belonging to the inner shell 28, said upper face 29 has a substantially horizontal profile.

At the level of the cavity 30, an air recirculation passage 35 is present, the latter comprises an air inlet 34 at a downstream part of the inner shell 28, and comprises an air injection outlet 36 arranged at the level of an upstream part of the inner shell 28.

In this configuration, a recirculation air flow 31 being a part of the air of the primary flow 18, particularly the part arranged radially at the foot of the stator vanes 24, enters the air recirculation passage 35 of the cavity 30 by means of the air inlet 34, the air then exits through the air injection outlet 36 to be reinjected into the vein 32 and thus join the primary flow 18.

According to the first embodiment, the air inlet 34 of the air recirculation passage 35 in the cavity 30 is exclusively located directly downstream of a trailing edge 44 belonging to the stator vanes 24, and particularly exclusively located directly downstream of a downstream edge of the inner shell 28.

The air injection outlet 36 is further defined, on the one hand, by a guide face 38 belonging to the inner shell 28 and arranged in its upstream part, and on the other hand, by an opposite guiding face 40 arranged upstream of the cavity 30, and belonging to a downstream part of the annular row of rotor blades 22.

The guide face 38 and the opposite guiding face 40 have axial profiles inclined downstream and radially outwards, relative to the radial direction. Preferably, the air injection outlet 36 has a main direction being substantially parallel to the inclined axial profiles and forming an angle $\alpha$ with the axial direction which is greater than or equal to 5° and/or less than or equal to 65°. Even more preferably, the angle $\alpha$ of inclination is at least 25° and/or less than or equal to 65°.

Preferably, the axial profile of the guide face 38 is generally rectilinear within a tolerance of ±15% and preferably ±10%.

The inclination of the air injection outlet 36 makes it possible to avoid reinjecting into the vein 32 a flow perpendicular to the direction of the primary flow, as is the case in the prior art. Indeed, the parasitic perpendicular flow causes mixing losses between the reinjected air and the main flow in the primary flow vein, which creates a blocking phenomenon caused by the reduction of an axial component of the speed vector incident on the stator blades and which results in a separation of the flow at the level of the stator blades inducing aerodynamic disturbances.

Advantageously, the inclination of the upstream part of the inner shroud 28 makes it possible to avoid slowing down the primary flow and to energize the latter, and to particularly energize the air located at the base of the stator vanes 24, commonly called boundary layer, and in which the air is adjacent to the upper face 29.

The profile of the guide face 38 extends downstream at least as far as a leading edge 42 of the stator vanes 24. Preferably, the profile of the guide face 38 extends downstream at beyond the leading edge 42 and over an axial distance X less than or equal to 50% of an axial chord length D of the stator vanes 24.

In this configuration, the axial profile of the guide face 38 is connected to the profile of the upper face 29 by means of a connector 27 ensuring the continuity of the guide face 38 towards the upper face 29.

Preferably, the connector 27 is curved with a sufficiently large radius to advantageously accelerate the air flow locally and to stabilize the flow at the level of the boundary layer.

The air injection outlet 36 has a distance C which corresponds to a gap between the guide face 38 and the opposite guiding face 40, and a common length E which represents the overlap length in which the guide face 38 faces the opposite guiding face 40, and radially covered by the latter. Preferably, said faces 38 and 40 are parallel.

The distance C is constant within a tolerance of ±10% along the common length E. For this purpose, the distance C varies at most up to a distance C+10%, and varies at the minimum up to a distance C−10%. The tolerance may depend on the machining precision and/or mounting of the different stages of the compressor.

Preferably, the guide face 38 and/or the opposite guiding face 40 is/are respectively circular and smooth over a total annular extent of said faces 38, 40. In this configuration, each of the faces 38 or 40, is preferably free of material, i.e. devoid of any protuberance. Advantageously, this makes it possible to guarantee homogeneity of the air flow reinjected into the vein 32.

The distance C is greater than or equal to one fifth of the common length E, this amounts to saying that the common length E is at most five times greater than the distance C. For this purpose, an overlap ratio E/C can be defined as being in the range of 1 to 5. Similarly, a P/E ratio can be defined as being at least equal to 0.2.

Advantageously, the E/C coverage ratio between 1 and 5 makes it possible to obtain a spacing between the row of rotor blades 22 and the row of stator blades 24 which is sufficiently large, this spacing corresponds to an operating clearance guaranteeing optimal operation and efficiency of the compressor, thus making it possible to obtain axial compactness of the turbomachine.

Preferably, the distance C is greater than or equal to one tenth of said radial height H. In this regard, the common length E is at most one half of the radial height H.

The recirculation air flow 31 in the cavity 30, and particularly in the air recirculation passage 35, has an air flow rate called recirculation flow rate, the latter depending in part on the distance C. To this end, the recirculation flow rate is proportional to the distance C, and therefore the greater the distance C, the higher the recirculation flow rate will be.

In this configuration, the recirculation flow rate reinjected into the vein 32 has a ratio with the nominal flow rate corresponding to at least half the ratio between a section of the air injection outlet 36 and a section of the vein 32.

According to the first embodiment, the air recirculation passage 35 in the cavity 30 is devoid of sealing devices, called seals, upstream of the air inlet 34, this advantageously makes it possible to increase the flow rate of recirculation. The term upstream here refers, by convention, to the main flow in the compression stage, whereas it is the air recirculation passage which is opposite to the main flow. If we refer to the direction of the air recirculation flow, the absence of a sealing device is downstream of the air inlet 34.

Indeed, the recirculation flow rate is in the order of 5% of the nominal flow rate, and preferably greater than 1% and/or less than 5% of the nominal flow rate. This result is mainly obtained by increasing the distance C as well as by eliminating the lips under the inner shell 28 upstream of the air inlet 34.

However, the same result, i.e. increasing the recirculation flow, can also be obtained by limiting the height of the drains.

Advantageously, the elimination or reduction of the height allows a gain in mass at the level of the turbomachine and a reduction in manufacturing costs.

Figure 3:
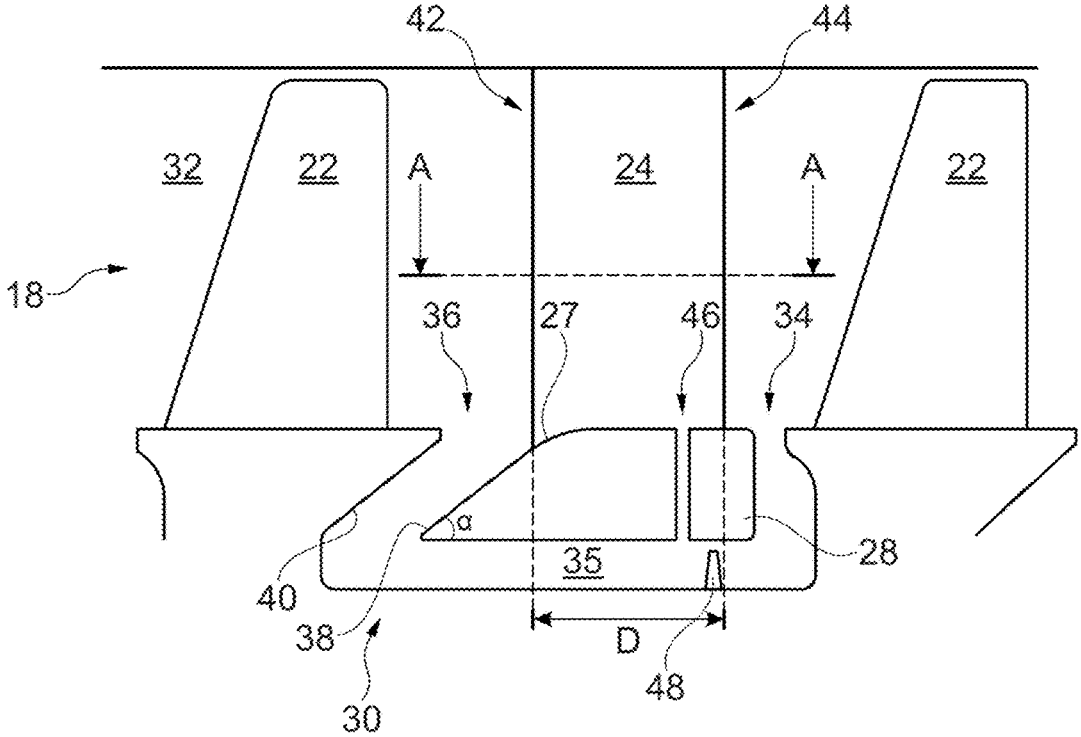
FIG. 3 schematically represents the compression stage according to a second embodiment of the invention.

FIG. 3 schematically represents the compression stage according to a second embodiment of the invention.

According to the second embodiment, part of the air circulating in the primary flow stream is taken upstream of the air inlet located downstream of the downstream edge of the shroud.

With reference to FIG. 3, the air inlet 34 of the air recirculation passage 35 in the cavity 30 comprises at least one orifice 46 passing radially through the inner shell 28, and the at least one orifice 46 is arranged annularly. between two neighboring stator blades 24. In addition, the at least one orifice 46 can be arranged axially throughout the length of the chord D of the stator vanes 24.

In this configuration, the at least one orifice 46 is configured to take a sample of air located at the foot of the stator vanes 24, said orifice 46 becomes the air inlet of the air recirculation passage 35 in the cavity 30, and the air inlet 34 becomes a second air inlet in said cavity 30. Indeed, any inlet for air in the cavity 30 located just downstream of the air injection outlet 36, i.e. the first air sample, will be designated as the air inlet.

For this purpose, the air recirculation passage 35 comprises at least one sealing device with wipers downstream of said at least one orifice 46, and preferably comprises a wiper 48. In this configuration, the air recirculation passage 35 is devoid of lips upstream of the air inlet, i.e. upstream of the at least one orifice 46. In fact, the air recirculation passage is devoid of lips between the at least one orifice 46 and the air injection outlet 36.

Preferably, the wiper is a single wiper for calibrating the air flow rates in the cavity 30 configured to promote the stability of the air in the air recirculation passage 35, this stability can be obtained by dimensioning the wiper 48 so as to control the air flow from the second air inlet 34 and to minimize the risk of aerodynamic disturbances in the air recirculation passage 35.

However, another wiper can be added upstream of the at least one orifice 46 in the case where the quantity of recirculation flow is greater than the ratio between the section of the air injection outlet 36 and the section of the vein 32.

Preferably, the compression stage according to the second embodiment of the present invention is similar to the stage according to the first embodiment previously described, and further comprises the at least one orifice 46 and the device for sealing downstream of said orifice 46.

Advantageously, sampling air according to the second mode makes it possible to increase and further control the recirculation flow rate in the cavity.

Figure 5:
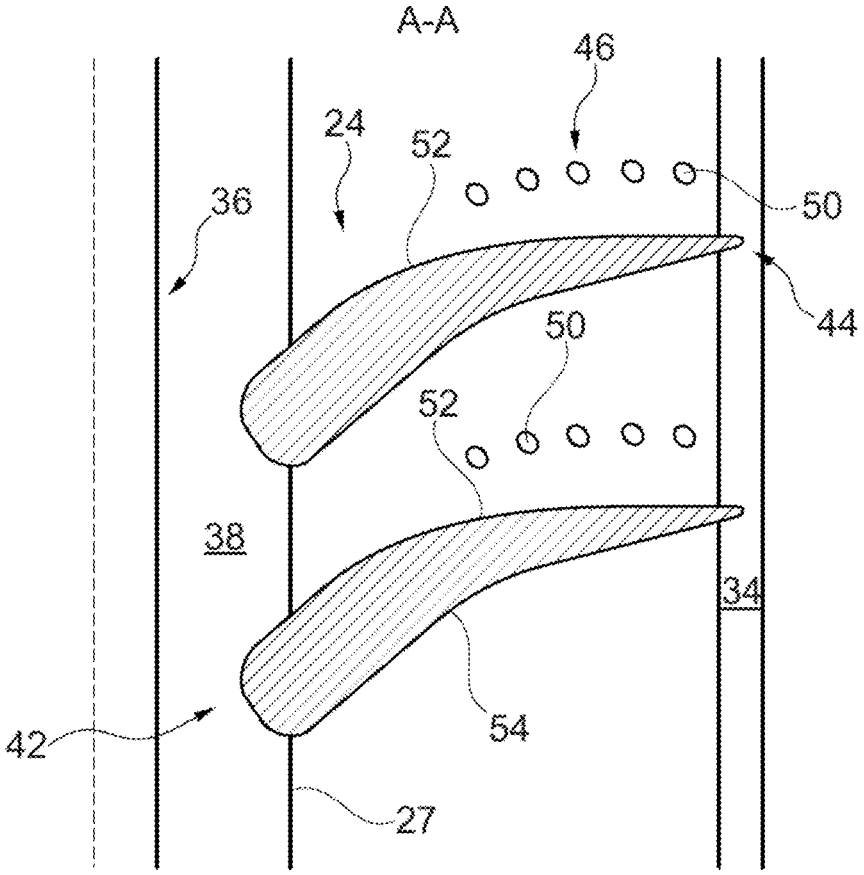
FIG. 5 represents the sectional view A-A of FIG. 3 according to a second alternative.
Figure 6:
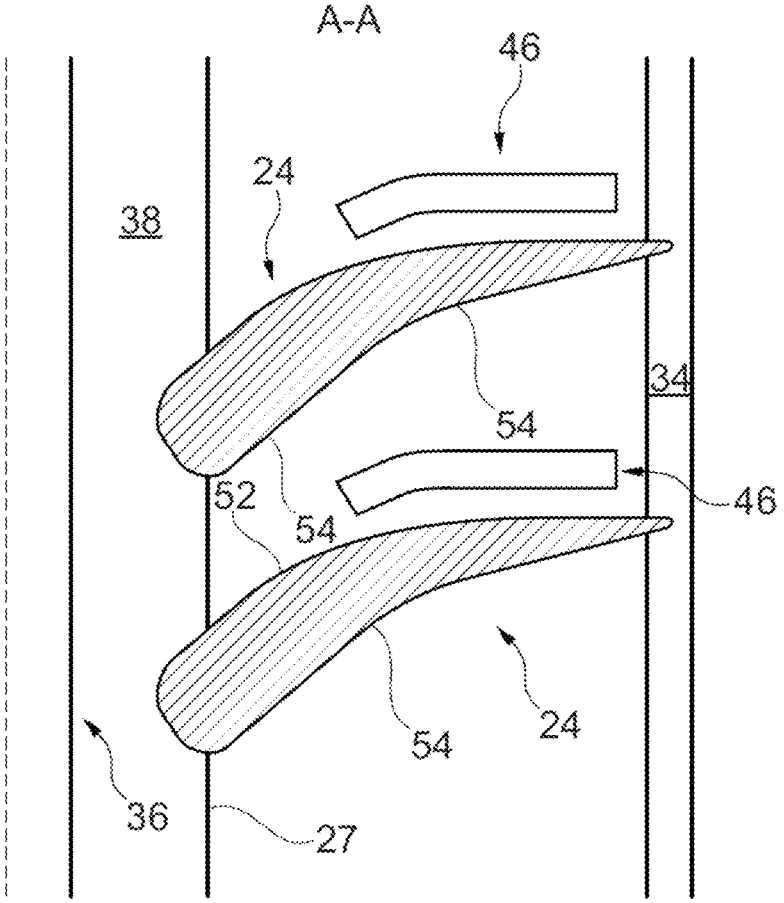
FIG. 6 represents the section A-A of FIG. 3 according to a third alternative.

The arrangement of the at least one orifice 46 is carried out according to three alternatives which will be described later in this description. For this purpose, FIGS. 4 to 6 are views from above FIG. 3 and particularly along section AA detailing the three alternatives.

Figure 4:
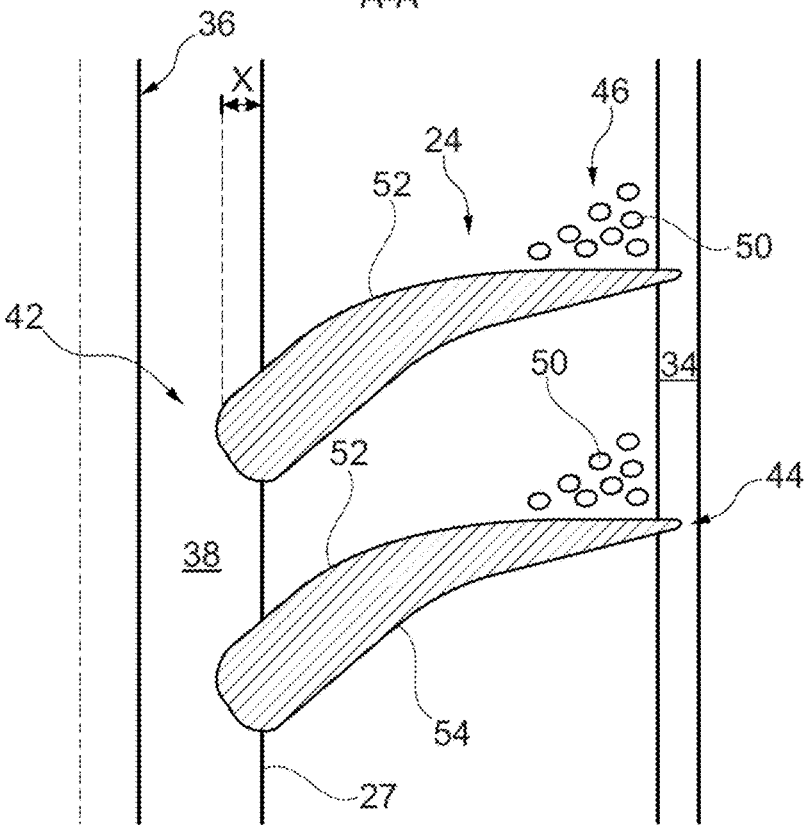
FIG. 4 is a sectional view A-A of FIG. 3 according to a first alternative.

FIG. 4 is a sectional view AA of FIG. 3 following a first alternative.

The average annular distance between two neighboring stator vanes 24 will be designated by "width of the channel" which is annularly delimited by an extrados face 52 of a stator vane 24 and by an intrados face 54 of another neighboring stator vane 24.

The axial length between the leading edge 42 and the trailing edge 44 will be referred to as "channel length", and half of said length will be referred to as mid-channel in the present description.

With reference to FIG. 4, the at least one orifice 46 is represented by several orifices 50 distributed with increasing density towards the downstream, i.e. the number of orifices 50 per unit area increases towards the downstream.

The at least one orifice 46 is located adjacent to a downstream half of the two neighboring stator vanes 24, i.e. in the downstream half of the channel. Preferably, the orifices 50 having a triangular shape being located adjacent to the trailing edges 44 of the stator vanes 24 and at a distance from the extrados face 52 less than 20% of the width of the channel.

Advantageously, the arrangement of the orifices 50 according to the first alternative makes it possible to attenuate a swirl generated by the stator vanes 24, called the corner swirl. In this regard, the orifices 50 draw air from the corner vortex to reinject it into the cavity.

FIG. 5 represents the sectional view AA of FIG. 3 according to a second alternative.

According to the second alternative, the at least one orifice 46 is represented by several orifices 50 aligned along the direction of the chord of the stator vanes 24. In this configuration, the orifices 50 being arranged between the mid-channel and the downstream part of the channel, i.e. from mid-channel to the trailing edge 44.

The orifices 50 are at a distance from the extrados face 52 less than 80% of the width of the channel and/or greater than 20% of said channel width. Preferably, the orifices 50 being arranged at half the width of the channel, and preferably, at a distance less than 50% of the width of the channel.

Advantageously, the arrangement of the orifices 50 according to the second alternative makes it possible to attenuate the aerodynamic disturbances which may occur at the foot of the stator vanes 24, including part of the corner vortex. For this purpose, the orifices 50 suck in air to reinject it into the cavity.

FIG. 6 represents the section AA of FIG. 3 according to a third alternative.

According to the third alternative, the at least one orifice 46 forms a slot 46 extending in the direction of the wedging or in the chord direction of the stator vanes 24, at a distance from each of the two neighboring stator vanes 24 which is between 20 and 80% of the width of the channel, and preferably between 40 and 60% of the width of the channel, and even more preferably, the slot 46 is arranged at approximately 50% of the width of the channel.

Preferably, the slot 46 has a direction parallel to the direction of the chord of the stator vanes 24. In this configuration, the slot 46 being arranged between the mid-channel and up to the trailing edge 44 at the level of the downstream part of the channel. However, the slot 46 may have a rectilinear direction.

Advantageously, the slot 46 makes it possible to suck in the parasitic perpendicular flow leaving the air injection outlet 36, starting from the intrados face 54 upstream towards the extrados face 52 downstream.

The arrangement of the at least one orifice 46 according to each of the three alternatives previously described can be combined with the arrangement according to another alternative in the same annular row of stator vanes, or in the same channel. For example, the orifices distributed with increasing density downstream of the first alternative can be in the same channel with the orifices aligned according to the second alternative or with the slot according to the third alternative.

It should be noted that the invention is not limited to the examples described in the figures. The teachings of the present invention may in particular be applicable to another type of turbomachine, and each technical characteristic of each illustrated example is applicable to the other examples.

The invention claimed is:

1. A compression stage for a compressor of a turbomachine, comprising:

an annular row of rotor blades extending radially outward from a rotor;

an annular row of stator blades extending radially inward from an outer shroud to an inner shroud housed in a cavity of the rotor, said annular row of stator blades being arranged directly downstream of the annular row of rotor blades; and an air recirculation passage in the cavity, with an air inlet at a downstream part of the inner shroud and an air injection outlet between a guide face upstream of said inner shroud and an opposite guiding face upstream of the cavity, said guide face and said opposite guiding face having axial profiles inclined downstream and radially outward, relative to a direction perpendicular to an axial direction;

wherein the air injection outlet defines a distance corresponding to a gap between the guide face and the opposite guiding face, and a length corresponding to a common length of said guide face and said opposite guiding face, said distance being greater than or equal to one-fifth of the common length, and the air recirculation passage in the cavity is devoid of a sealing device upstream of the air inlet, wherein upstream defines a main air flow direction in the compression stage.

2. The compression stage according to claim 1, wherein the guide face and the opposite guiding face are parallel and the distance between the guide face and the opposite guiding face is constant within a tolerance of ±10% along the common length of said guide face and said opposite guiding face.

3. The compression stage according to claim 1, wherein the guide face and the opposite guiding face are circular and smooth over a total annular extent of said guide face and said opposite guiding face, respectively.

4. The compression stage according to claim 1, wherein the air injection outlet has a main direction forming an angle with the axial direction that is greater than or equal to 5°.

5. The compression stage according to claim 1, wherein an axial profile of the guide face is rectilinear within a tolerance of +10% and extends downstream at least up to a leading edge of the stator blades.

6. The compression stage according to claim 5, wherein the axial profile of the guide face extends downstream beyond the leading edge of the stator blades, over an axial distance less than or equal to 50% of an axial chord length of the stator blades.

7. The compression stage according to claim 1, wherein the air inlet of the air recirculation passage in the cavity is exclusively located directly downstream of a downstream edge of the inner shroud.

8. The compression stage according to claim 1, wherein the air inlet of the air recirculation passage in the cavity comprises at least one orifice radially traversing the inner shroud between two adjacent stator blades.

9. The compression stage according to claim 8, wherein the at least one orifice is at a distance from an extrados face of one of the two adjacent stator blades that is less than 50% of an average distance between said two adjacent stator blades and located adjacent to a downstream half of said two adjacent stator blades.

10. The compression stage according to claim 9, wherein the air inlet of the air recirculation passage in the cavity comprises several orifices of the at least one orifice, distributed with increasing density towards the downstream.

11. The compression stage according to claim 10, wherein the at least one orifice forms a slot extending along a chord direction of the stator blades, at a distance from each of the two adjacent stator blades that is between 40 and 60% of an average distance between said two adjacent stator blades.

12. The compression stage according to claim 8, wherein the air recirculation passage in the cavity comprises at least one sealing device downstream of the at least one orifice, wherein downstream defines a main air flow direction in the compression stage.

13. The compression stage according to claim 8, wherein the at least one orifice is at a distance from an extrados face of one of the two adjacent stator blades that is 30% of an average distance between said two adjacent stator blades and located adjacent to a downstream half of said two adjacent stator blades.

14. The compression stage according to claim 1, wherein the air injection outlet has a main direction forming an angle with the axial direction that is less than or equal to 65°.

15. The compression stage according to claim 1, wherein the air injection outlet has a main direction forming an angle with the axial direction that is between 25° and 65°.

16. A compressor of a turbomachine, comprising several compression stages, wherein at least one of said compression stages comprising:

an annular row of rotor blades extending radially outward from a rotor;

an annular row of stator blades extending radially inward from an outer shroud to an inner shroud housed in a cavity of the rotor, said annular row of stator blades being arranged directly downstream of the annular row of rotor blades; and an air recirculation passage in the cavity, with an air inlet at a downstream part of the inner shroud and an air injection outlet between a guide face upstream of said inner shroud and an opposite guiding face upstream of the cavity, said guide face and said opposite guiding face having axial profiles inclined downstream and radially outward, relative to a direction perpendicular to an axial direction;

wherein the air injection outlet defines a distance corresponding to a gap between the guide face and the opposite guiding face, and a length corresponding to a common length of said guide face and said opposite guiding face, said distance being greater than or equal to one-fifth of the common length, and the air recirculation passage in the cavity is devoid of a sealing device upstream of the air inlet, wherein upstream defines a main air flow direction in the compression stage.

17. The compression stage according to claim 16, wherein said compressor comprises an axial flow path radially delimited externally by a stator wall, and radially delimited internally by the rotor, said axial flow path defining a radial height, the distance being greater than or equal to one-tenth of said radial height.

18. The compression stage according to claim 16, wherein the axial flow defines a nominal flow rate and the air recirculation passage in the cavity defines a recirculation flow rate, said recirculation flow rate re-injected into the axial flow path having with the nominal flow rate a ratio corresponding to at least half of a ratio between a section of the air injection outlet and a section of the axial flow path.

19. A turbomachine comprising a compressor comprising a plurality compression stages, wherein at least one of said compression stages comprising:

an annular row of rotor blades extending radially outward from a rotor;

an annular row of stator blades extending radially inward from an outer shroud to an inner shroud housed in a cavity of the rotor, said annular row of stator blades being arranged directly downstream of the annular row of rotor blades; and an air recirculation passage in the cavity, with an air inlet at a downstream part of the inner shroud and an air injection outlet between a guide face upstream of said inner shroud and an opposite guiding face upstream of the cavity, said guide face and said opposite guiding face having axial profiles inclined downstream and radially outward, relative to a direction perpendicular to an axial direction;

wherein the air injection outlet defines a distance corresponding to a gap between the guide face and the opposite guiding face, and a length corresponding to a common length of said guide face and said opposite guiding face, said distance being greater than or equal to one-fifth of the common length, and the air recirculation passage in the cavity is devoid of a sealing device upstream of the air inlet, wherein upstream defines a main air flow direction in the compression stage.

* * * * *